US011788316B2

(12) United States Patent
Mutevelic

(10) Patent No.: US 11,788,316 B2
(45) **Date of Patent: *Oct. 17, 2023**

(54) SYSTEM AND METHOD FOR EATERY

(71) Applicant: Hamza Mutevelic, Vienna (AT)

(72) Inventor: Hamza Mutevelic, Vienna (AT)

(73) Assignees: Hamza Mutevelic, Vienna (AT); Jasminka Cirkic, Saddle Brook, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/443,694

(22) Filed: Jul. 27, 2021

(65) Prior Publication Data

US 2021/0363773 A1 Nov. 25, 2021

Related U.S. Application Data

(63) Continuation of application No. 14/901,429, filed as application No. PCT/AT2013/000150 on Sep. 12, 2013, now Pat. No. 11,072,939.

(51) Int. Cl.

| | |
|---|---|
| ***E04H 1/12*** | (2006.01) |
| ***E04H 3/02*** | (2006.01) |
| ***E04H 12/18*** | (2006.01) |
| ***E04B 1/34*** | (2006.01) |
| ***E04B 1/343*** | (2006.01) |

(52) U.S. Cl.

CPC ..... *E04H 12/182* (2013.01); *E04B 1/34363* (2013.01); *E04H 1/1222* (2013.01); *E04H 3/02* (2013.01)

(58) Field of Classification Search

CPC ..... E04H 1/12; E04H 1/1222; E04H 1/1205; E04H 3/00; E04H 3/02; E04H 9/145; E04H 12/182; E04B 1/3404; E04B 1/3408; E04B 1/3412; E04B 1/3416; E04B 1/34336; E04B 1/34352; E04B 1/34363; E04B 1/346; E04B 1/3465

See application file for complete search history.

(56) References Cited

U.S. PATENT DOCUMENTS

| | | | | |
|---|---|---|---|---|
| 3,125,189 A * | 3/1964 | Graham | E04B 1/346 | 52/247 |
| 3,246,431 A * | 4/1966 | Faerber | E04B 1/346 | 52/73 |
| 3,895,473 A * | 7/1975 | Fraser | E04B 1/3404 | 52/125.1 |
| 3,905,166 A * | 9/1975 | Kaiser | E04B 1/3465 | 52/73 |
| 3,943,671 A * | 3/1976 | Curci | E04B 1/3408 | 52/73 |

(Continued)

FOREIGN PATENT DOCUMENTS

| | | |
|---|---|---|
| CN | 205617842 U * | 10/2016 |
| CN | 106351473 A * | 1/2017 |

(Continued)

*Primary Examiner* — Ryan D Kwiecinski

(74) *Attorney, Agent, or Firm* — Bold IP, PLLC; Christopher Mayle

(57) ABSTRACT

A system and method for an eatery having at least one table element and at least one seating element with a moveable and accessible platform on which the at least one table element and at least one seating element are arranged.

6 Claims, 9 Drawing Sheets

(56) References Cited

U.S. PATENT DOCUMENTS

| | | | | | |
|---|---|---|---|---|---|
| 4,817,345 | A * | 4/1989 | McGlew | E04B 1/346 | 52/64 |
| 5,974,743 | A * | 11/1999 | Vaia | E04H 9/14 | 52/169.1 |
| 6,457,280 | B1 * | 10/2002 | Park | E03C 1/00 | 52/73 |
| 7,992,350 | B2 * | 8/2011 | Vriens | E04B 1/3412 | 52/73 |
| 8,302,357 | B1 * | 11/2012 | Nolte | E02D 31/002 | 52/294 |
| 8,696,479 | B2 * | 4/2014 | Marks | E04H 12/00 | 182/141 |
| 10,365,062 | B2 * | 7/2019 | Oesch | E04B 1/34315 | |
| 10,753,080 | B1 * | 8/2020 | Houston | E04B 1/3516 | |
| 2016/0138290 | A1 * | 5/2016 | Dautaj | E04H 1/1222 | 52/67 |
| 2019/0137084 | A1 * | 5/2019 | Kim | H04N 7/18 | |

FOREIGN PATENT DOCUMENTS

| | | | | | |
|---|---|---|---|---|---|
| CN | 106401258 | A * | 2/2017 | | |
| CN | 106988423 | A * | 7/2017 | E04B 1/3408 | |
| CN | 107152086 | A * | 9/2017 | E04B 1/346 | |
| DE | 102017114090 | A1 * | 12/2018 | E04B 1/3516 | |
| EP | 2813644 | A3 * | 3/2015 | E04B 1/346 | |
| FR | 2580708 | A1 * | 10/1986 | | |
| GB | 2416787 | A * | 2/2006 | E04B 1/34363 | |

* cited by examiner

SYSTEM AND METHOD FOR EATERY

CROSS REFERENCE TO RELATED APPLICATIONS

This application a continuation that claims priority to Non-Provisional application Ser. No. 14/901,429 filed on Dec. 28, 2015 and PCT application AT/2013/000150, filed Sep. 12, 2013.

FIELD OF DISCLOSURE

The field of disclosure is generally to an eatery having at least one table element and at least one seating element and more particularly an eatery that raises and lowers in response to a food and drink ordering system.

BACKGROUND

Open-air eating areas, such as beer gardens or sidewalk eateries, are a widely popular extension of food service businesses in warm seasons, albeit in many places compromised by sound and pollutant effects, such as in the form of exhaust gas or particles. An additional drawback is the relative exposition to observations by persons present or passing as well as interference by weather as it can sometimes occur. It is thus a task of the invention to provide an eatery of the kind initially mentioned, which provides protection against the external influences listed above along with the possibility of unhindered service and conversation among guests as well as air conditioning.

It is thus a need to provide an eatery of the kind initially mentioned, which provides protection against the external influences listed above along with the possibility of unhindered service and conversation among guests as well as air conditioning.

SUMMARY

The disclosure presented herein relates to an eatery having at least one table element and at least one seating element, wherein an accessible platform, on which the at least one table element and the at least one seating element is arranged, is provided, and wherein at least one elevation device for raising the accessible platform is arranged in an area below the accessible platform, wherein the accessible platform is moveable between a basic position on ground level and a lookout position at a level elevated as compared to the ground level wherein the accessible platform moves from the ground position to the lookout position in response to a received food or drink order, wherein the accessible platform is rotatable around a vertical axis, the accessible platform having a plurality of window areas, wherein an at least practically closed cabin space is disposed on the accessible platform, in which the at least one table element and the at least one seating element are included, a credit card reader integrated into the table element for processing of orders, wherein a touchscreen is imbedded in the table element, the touchscreen having control commands for a rotation speed of the accessible platform, wherein a cabin space has a top and wherein at least one exterior wall is disposed, on an inside of which the at least one seating element is arranged or integrated, the top transparent and made of an acrylic glass configured to allow for unimpeded observation of an environment and a projection wall, wherein the cabin space is enterable via at least one pivotable and slidable lockable door element, wherein the at least one elevation device is provided with tubes to be pushed in and pulled out telescopically using an elevation drive, by which the accessible platform can be moved in height, wherein the at least one elevation device is formed by a telescopic cylinder that can be pushed in and pulled out along a central vertical axis, wherein in its basic position, the accessible platform is surrounded by a cordon, one or more lights connected to the cordon, the cordon showing if the eatery is currently occupied.

The disclosure presented herein also relates to an eatery having a seating area, the seating area having at least one table element and at least one seating element, wherein a platform, on which the at least one table element and the at least one seating element are arranged, is provided, and wherein at least one elevation device for raising the platform is arranged in an area below the platform, wherein the platform is moveable between a basic position on ground level and a lookout position at a level elevated as compared to the ground level, the eatery having a top supported by a plurality struts which are anchored at their bottom ends in exterior wall elements, further comprising an annular member configured to accommodate a plurality of loudspeakers, an integrated cooling and heating system, ventilation slots are integrated into the seating area of the seating elements, a circular stabilizing disc used to secure the platform against tilting, the platform raised in response to a received food or drink order from an ordering interface, wherein the platform lowers in response to a predetermined time lapse since a last food or drink order was received, wherein the platform is rotatable around a vertical axis, wherein the top and made of an acrylic glass configured to allow for unimpeded observation of an environment and a projection wall, further comprising a credit card reader integrated into the table element for processing of orders, a touchscreen imbedded in the table element, the touchscreen having control commands such as elevating and lowering the platform and a rotation speed of the platform.

BRIEF DESCRIPTION OF DRAWINGS

The present invention will be described by way of exemplary embodiments, but not limitations, illustrated in the accompanying drawings in which like references denote similar elements, and in which:

FIG. 3 illustrates an oblique top view of the eatery of FIG. 1 with the vault raised of.

DETAILED DESCRIPTION

Figure 1:
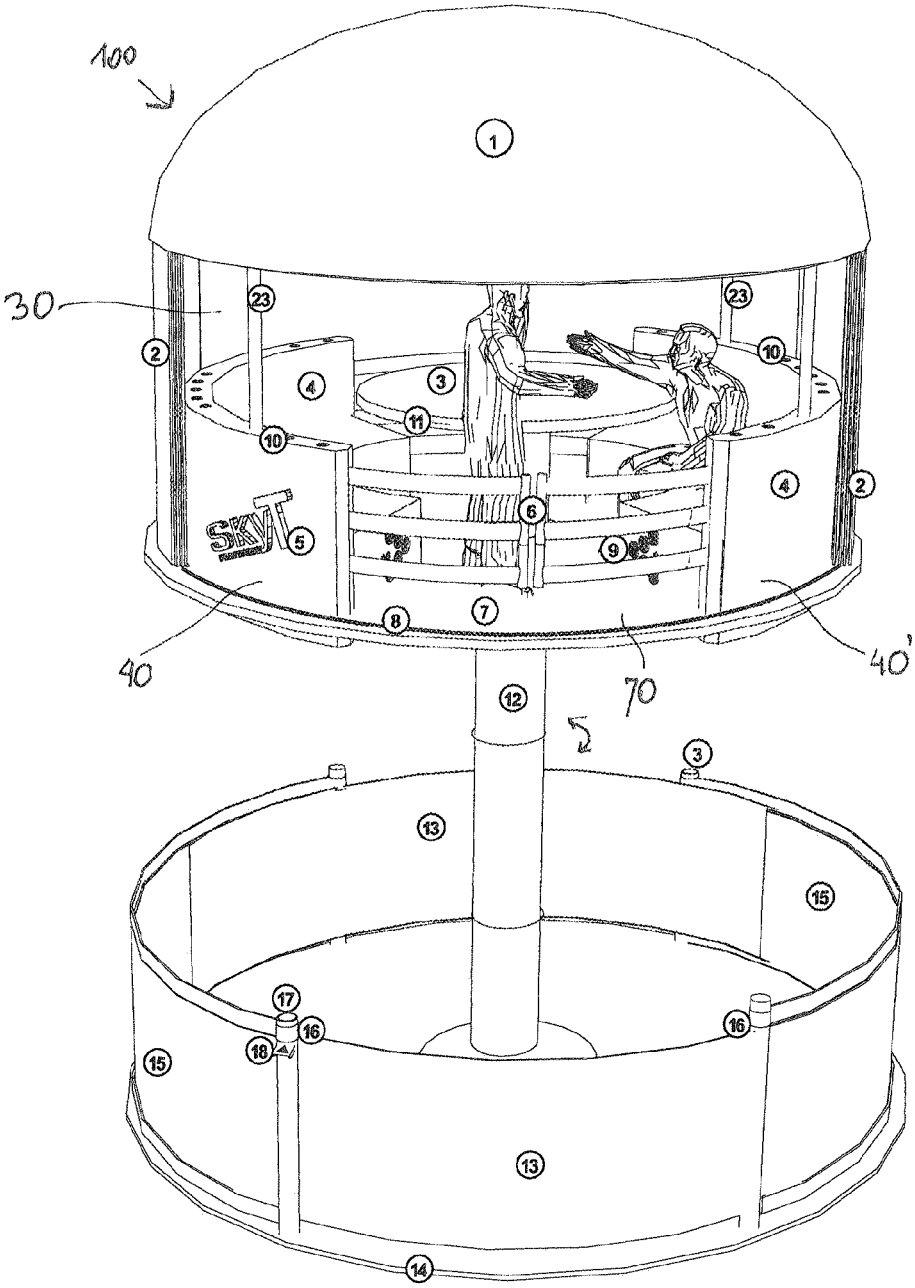
FIG. 1 illustrates an oblique top view of an embodiment of the eatery according to the invention.

In the Summary above and in this Detailed Description, and the claims below, and in the accompanying drawings, reference is made to particular features of the invention. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items," may indicate the presence of only one item, or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The core of the invention is a a moveable and accessible platform, on which the at least one table element and the at least one seating element are arranged, with at least one elevation device for raising the platform being arranged in the area below the platform, thus the platform moveable in height, which can be set up without requiring much space, for example, in the beer garden of a food service business, and which can be placed in an area offset in height as compared to ground level, in which little or no external interference will occur, such that guests can spend their stay at the premises undisturbed by passing persons or vehicles. In addition, the platform provides further possibilities of shielding against external influences, such as pollutant emissions, noise or the weather, including wind, snow, or rain.

The eatery according to the invention is a delimited area, which can be raised and placed, for example, outside a restaurant even at a busy street, protecting a guest or group of guests from the immediate influences of street level.

Guest service may be via a restaurant located in the immediate proximity, but also on self-service units arranged on the platform, such as drinks or food dispensers. If an order is placed to the adjacent restaurant, the service personnel will bring the order to the platform, which can be lowered for this purpose.

Should persons stay on the platform without consuming anything, it cannot be raised, or is lowered. Only when an order is placed does the possibility of utilizing the service become active. When no orders have been placed within a certain time span, the platform is lowered automatically.

In a particularly preferred manner, the platform is moveable between a basic position on ground level and a lookout position elevated as compared to ground level, such that guests staying on the platform are able to observe the environment without structural obstruction.

In another embodiment of the invention, the platform can be rotatable around a vertical axis, allowing guests the pleasure of a panoramic view of the environment.

According to another embodiment of the invention, an at least partially closed cabin space can be disposed on the platform, in which the at least one table element and the at least one seating element are included.

A stay inside the cabin space provides protection against external influences such as heat, rain, wind, or snow with the option to perform respective air conditioning inside the cabin space by cooling and heating as well as inlet and outlet air devices. Inlet and outlet of air or heating or cooling media, respectively, can be via tubes that can, for example, partially be directed into the cabin space within the elevation device.

Individually placed platforms in an external area without a restaurant may have a heat/climate pump integrated into the platform. Additional electricity supply via solar or photovoltaic systems may be provided for more southern regions with a large number of sunny days.

The table element located on the platform may include other functions in addition to the food service purpose; for example, the table element may include a touchscreen integrated into the table surface. That way, guests will have a large screen or several displays at their disposal, on which, for example, the food and drinks menu can be displayed.

Payment can be placed with the service personnel or on the platform via bankcard or credit card, or with a dedicated user card.

As an additional service option, guests can also be given the opportunity to have various backgrounds or media images and videos displayed in a glass and/or acrylic glass vault located above the table element upon payment of a fee, such as music videos, news, movies, or making phone calls, as desired according to their personal taste. Also, the platform can have Internet access or a telephone connection.

Another variant of the invention can thus be that the cabin space has a vault-like top and that at least one exterior wall is disposed, on the inside of which the at least one seating element is arranged or integrated.

For safety reasons, and to avoid unauthorized invasion of the cabin space, the cabin space can be enterable via at least one lockable door element.

Furthermore, the platform and/or the cabin space can be closable completely or partially as desired using automatically adjustable sliding doors.

In another embodiment of the invention, the at least one elevation device can be provided with tubes to be pushed in and pulled out telescopically using an elevation drive, by which the platform can be moved in height. In a particularly preferred manner, the elevation device can be formed by a telescopic cylinder to be pushed in and pulled out along a central vertical axis, which is arranged on the ground in an adequately stable manner to be able to move the platform between the street-level position and the elevated position. In the invention, however, other mechanisms can be provided as well to allow moving the platform in height.

For safety reasons, the platform can be surrounded by a cordon in its ground position, which is made, for example, of a wire fence or a safety glass and prevents invasion of the area below the elevated platform. In addition, the two entry areas of the platform can be closed by an automatically closing barrier made of metal when in the elevated position to prevent persons from falling off.

Optionally available privacy glazing of the platform allows for sufficient privacy to prevent undesired gazes from persons passing by outside. The guest, on the other hand, is of course able to observe the outside area if he or she desires.

Furthermore, the invention relates to a beer garden consisting of one or more eateries according to the invention.

Figure 2:
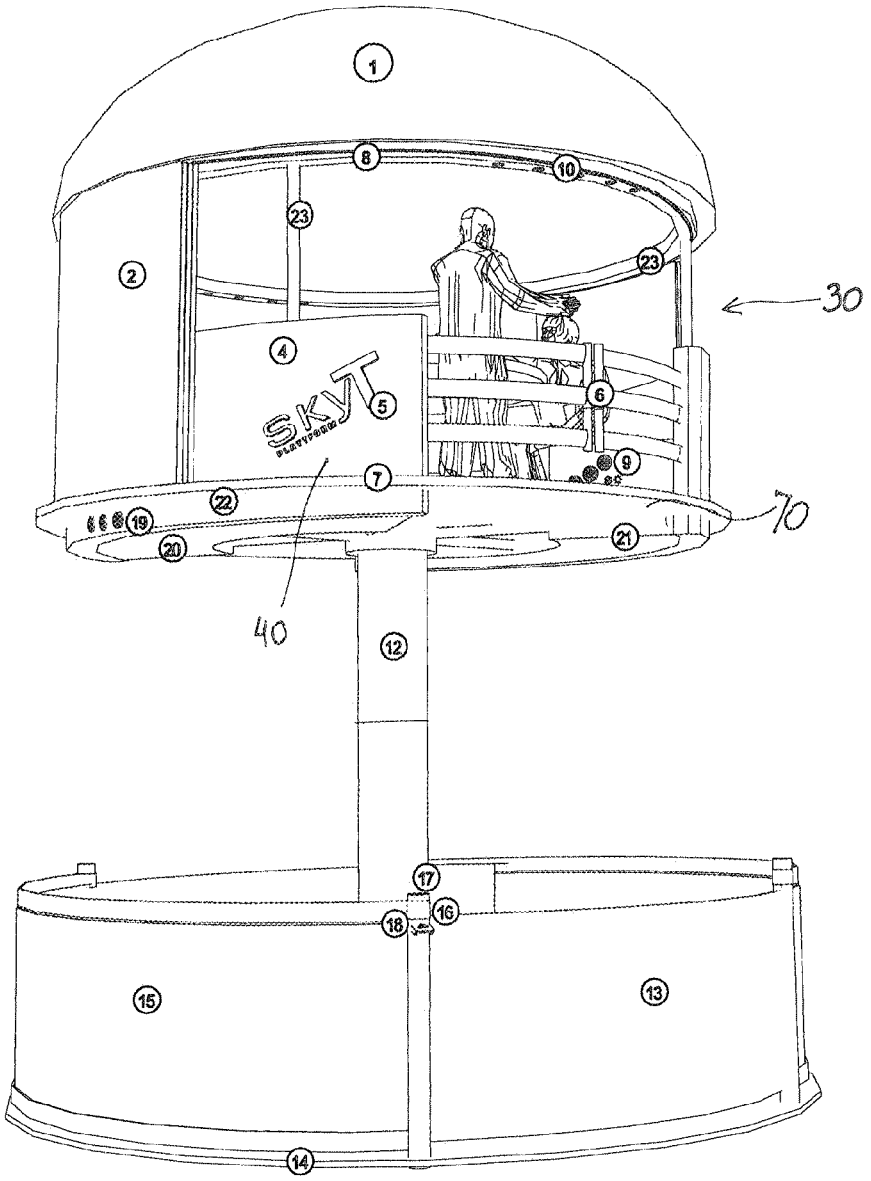
FIG. 2 illustrates an oblique bottom view of the eatery of FIG. 1.
Figure 3:
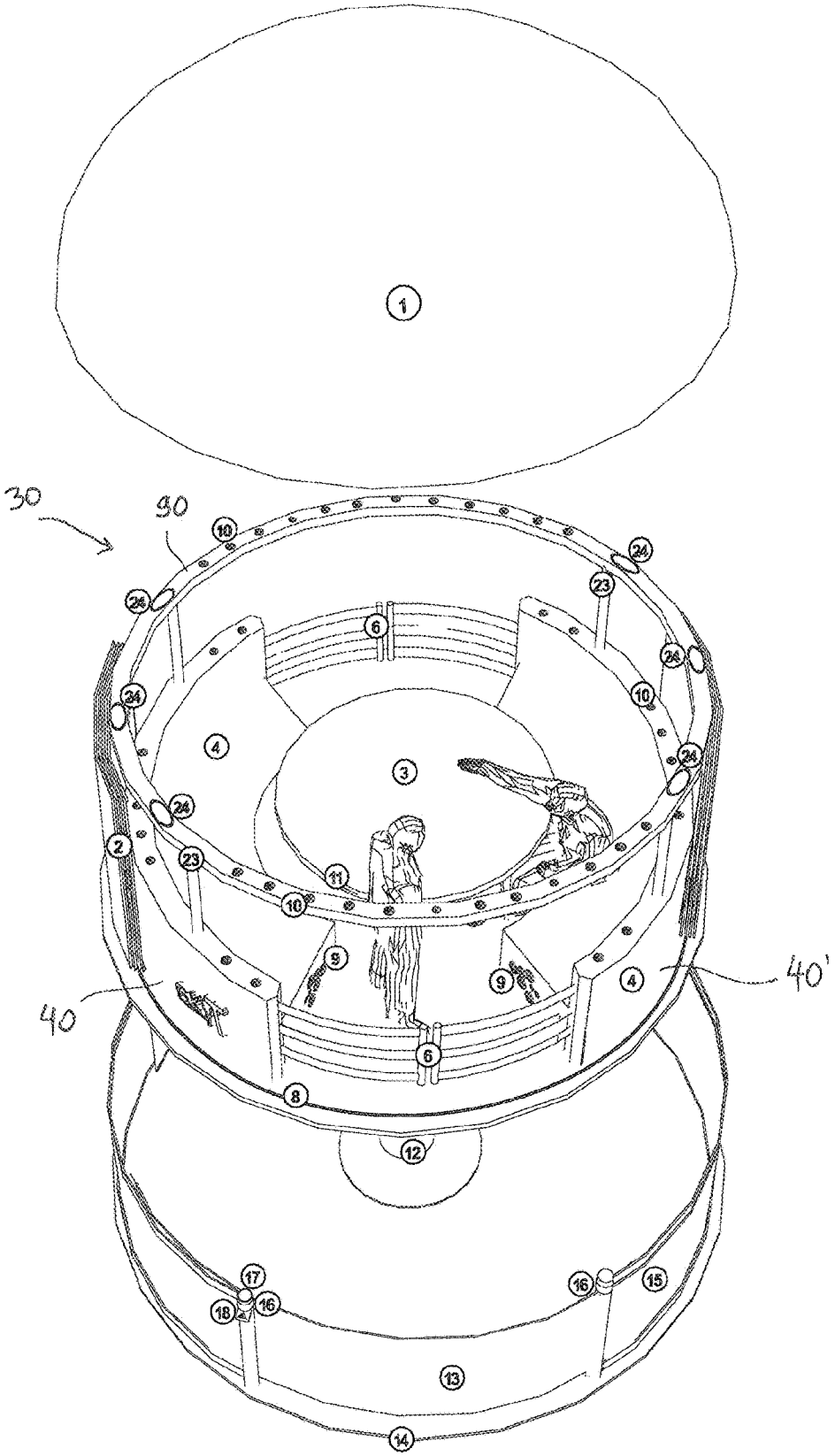

FIGS. 1, 2, and 3 illustrate an eatery 100 for serving and/or entertaining guests having one table element 3 and two seating elements 4, with a moveable and accessible platform 7 being provided according to the invention, on which the one table element 3 and the two seating elements 4 are arranged.

Eatery 100 may utilize a control system for remote activation of the various mechanisms including raising and lowering the platform. The control system may operate to control the actuation of the other systems. The control system may have a series of computing devices. The control system may be in the form of a circuit board, a memory, or other non-transient storage medium in which computer-readable coded instructions are stored and one or more processors configured to execute the instructions stored in the memory. The control system may have a wireless transmitter, a wireless receiver, and a related computer process executing on the processors.

Computing devices of the control system may be any type of computing device that typically operates under the control of one or more operating systems which control scheduling of tasks and access to system resources. Computing devices may be any computing device capable of executing instructions with sufficient processor power and memory capacity to perform operations of the control system.

The one or more computing devices may be integrated into the control system, while in other non-limiting embodiments, the control system may be a remotely located computing device or server configured to communicate with one or more other control systems. The control system may also include an internet connection, network connection, and/or other wired or wireless means of communication (e.g., LAN, etc.) to interact with other components. The connection allows a user to update, control, send/retrieve information, monitor, or otherwise interact passively or actively with the control system.

The control system may include control circuitry and one or more microprocessors or controllers acting as a servo control mechanism capable of receiving input from sensors and other components analyzing the input from sensors and other components, and generating an output signal to components. The microprocessors (not shown) may have on-board memory to control the power that is applied to the various systems. The control system may be preprogrammed with any reference values by any combination of hardwiring, software, or firmware to implement various operational modes including but not limited to temperature, light, and humidity values.

The microprocessors in the control system may also monitor the current state of circuitry within the control system to determine the specific mode of operation chosen by the user. Further, such microprocessors that may be part of the control system may receive signals from any of or all systems. Such systems may be notified whether any of the components in the various systems need to be replaced.

The table element 3 has a circular tabletop, in which a touchscreen 401 is embedded, from which, for example, control commands can be entered, for example, orders based on a menu through a food and drink ordering interface, elevating and lowering the platform 7, rotation speed of the platform 7, etc. This may be conducted by one or more computing devices of the control system with one or more processors connected to one or more databases and capable of controlling eatery 100 over a network or server. Both the height movement and the rotation movement of the platform 7 are controllable from the cabin space 30.

In one or more embodiments eatery 100 may include a wireless communication interface, which may be a digital, analog, or mixed-signal circuit to transmit wireless signals indicating user input received from eatery 100. The wireless signals may be transmitted to a remote computing device such as a phone, a computer, a wearable device, tablet, a virtual reality system, etc. The wireless communication interface may send and receive data via a wireless network such that the user may control platform 7 as well as order or inquire about various items.

To perform the height movement of the platform 7, an elevation device 12 is arranged in the area below the platform 7. The platform 7 is moveable between a basic position on ground level and a lookout position at a level elevated as compared to bottom level and rotatable around a vertical axis (curved dual arrow in FIG. 1) corresponding to the central axis of the elevation device 12.

The guests staying on the platform 7 can thus, on the one hand, using the platform 7, be brought to an elevated position in which they sit or stand at a distance from the ground, while on the other hand, rotations of the platform 7 around the vertical axis can be executed by an adequate engine not shown to allow a better view of the environment.

The platform 7 shown in FIGS. 1 through 3 has a polygonal, near-circular platform bottom 70, in the circumferential area of which adequately curved exterior wall elements 40, 40' are provided.

An at least partially closed cabin space 30 is disposed in the platform 7, in which the table element 3 and the two seating elements 4 are included, which are executed as seating benches, the rear wall of which is the respective interior side of each of the two curved opposite exterior wall elements 40, 40'. The openings present in a circumferential direction between their ends can be locked using lockable door elements 6 and be entered through the openings in an opened position of the interior of the cabin space 30. For safety reasons, the pivotable and sliding door elements 6 must not be opened in the lookout position of the platform 7; they are automatically closed when the platform 7 is elevated.

Light fixtures, preferably LED lights 10 to illuminate the cabin space 30 are distributed over the top of the exterior wall elements 40, 40' and the bottom of the vault-like top 1.

Ventilation slots 9 are integrated into the seating area of the seating elements 4, via which adequate air conditioning can take place. To this end, an integrated heating system 20 and an integrated cooling system 21 are provided at the bottom of the platform 7, via which heating and cooling of the cabin space 30 can take place when the sliding door elements 2 are closed.

The table element 3 has a circular tabletop, in which a touchscreen 401 is embedded, from which, for example, control commands can be entered, for example, orders based on a menu, elevating and lowering the platform 7, rotation speed of the platform 7, etc. Both the height movement and the rotation movement of the platform 7 are controllable from the cabin space 30.

Furthermore, automatic control of the movements of platform 7 can be conducted in response to consumption behavior. For example, it can be provided that one hour following the last order placed by a guest, the platform 7 is lowered to its basic position with the door elements being opened to signal that the time of use has ended. The use of a drinks dispenser, which may, for example, be positioned inside the cabin space, or the chargeable booking of a video may, for example, also be regarded as orders.

A credit-card reader unit 11 is incorporated into the table element 3, via which various orders, either in the way of the restaurant services or, for example, in the way of data or video content, can be placed.

In spite of its technological content, the table element 3 is primarily designed for the consumption of food and the consumption of drinks.

The cabin space 30 has a vault-like top 1 made of acrylic glass (PMMA), which is executed to be transparent and thereby allows unimpeded observation of the environment, but also serves as a vaulted projection wall for video and/or data displays as desired. To this end, suitable dimming elements may be provided, which allow for the transparent top 1 to be covered even at times of intense sunlight, for example.

The vault-like top 1 is supported by several struts 23, which are anchored at their bottom ends in the exterior wall elements 40, 40' spaced apart along their circumference and connected at their top ends by an annular member 90 (FIG. 3), in which several loudspeakers 24 are also accommodated distributed along the circumference, which allow for uniform sonication of the cabin space 30.

Window areas are left between the struts 23, through which the environment can be observed.

As shown in FIG. 1 and FIG. 2, one sliding door rail 8 each extends along the outer circumference of the platform bottom 70 and, offset therefrom in height, at the bottom edge of the vault-like top 1 in order to guide transparent sliding door elements 2 along the bottom. While the sliding door elements 2 are depicted in their parallel-telescoped position in FIGS. 1, 2, and 3, they can be moved into their slid-apart position until the entire cabin space 30 is closed by the lined-up sliding door elements 2, such that neither sound not pollutants are able to invade from the outside. Movement of the sliding door elements 2 is conducted via a controllable engine 22 arranged at the bottom of the platform 7.

Outlet air openings 19 are provided to discharge the consumed air (FIG. 2), while heated or cooled fresh air is introduced into the cabin space 30 via slits in the struts 23.

The elevation device 12 is equipped with tubes that can be telescopically pushed in and pulled out using an elevation drive and that can be used to move the platform 7 in height. According to the present exemplary embodiment, elevation device 12 is formed by a telescopic cylinder that can be pushed in and pulled out along a central vertical axis, the top end of which is attached to the bottom of the platform 7.

At its bottom, the elevation device 12 is connected to a circular stabilizing disc 14 used to secure the platform 7 against tilting.

In its basic position, the platform 7 is surrounded by a cordon 15, e.g., a latticework running circular, which has two opposite openable door areas 13, through which persons can enter the cabin space 30 through the opened door elements 6, as long as the platform 7 is lowered to ground level. A door opener 17 and a door-opener reader unit 18 allow controlling access to the cabin space 30.

Figure 4:
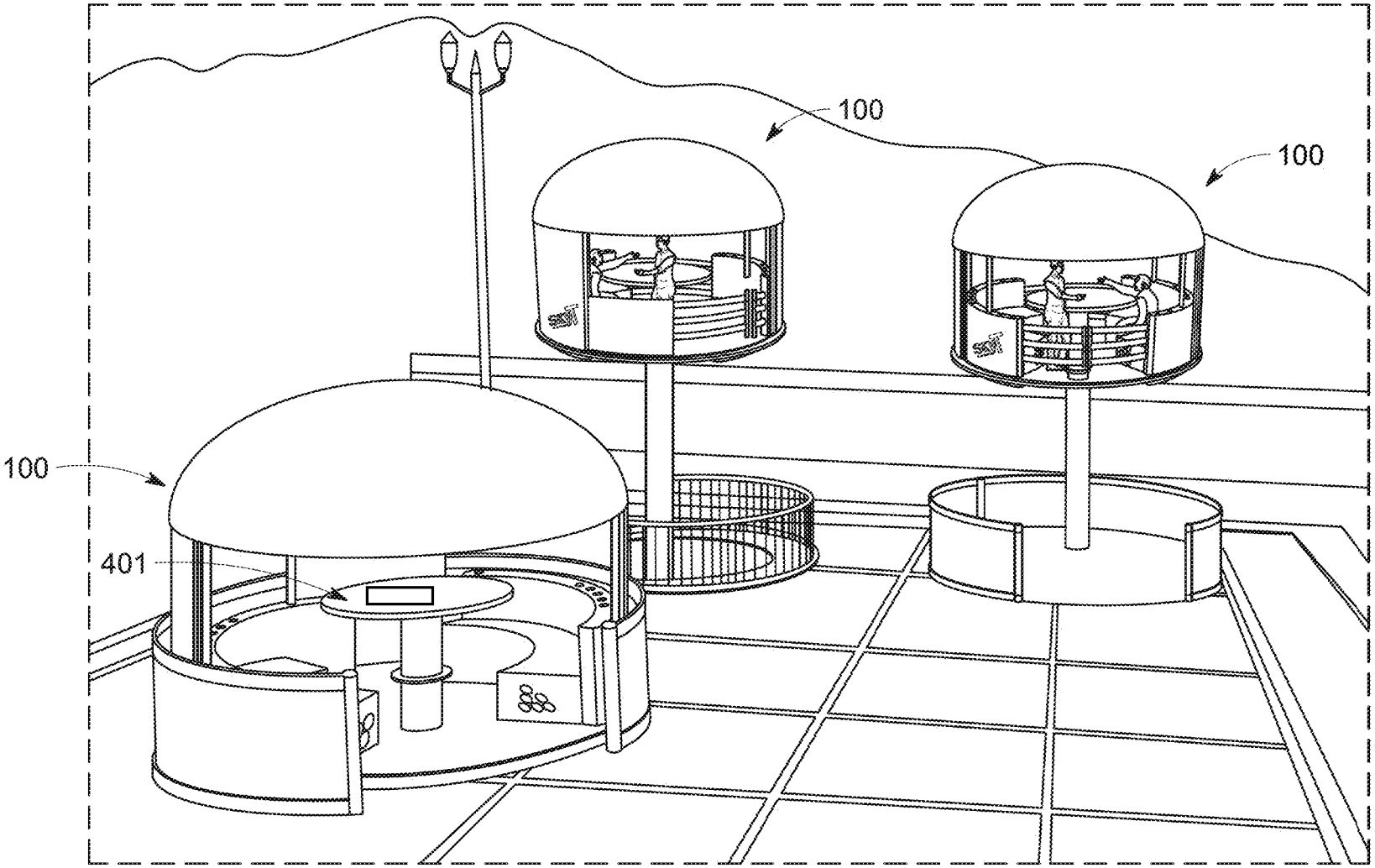
FIG. 4 illustrates an oblique view of a beer garden having several eateries according to the invention.

Lights 16 mounted to the cordon 15 signal whether the platform is currently used by guests. FIG. 4 illustrates a beer garden, in which three eateries 100 according to the invention are arranged.

Figure 5:
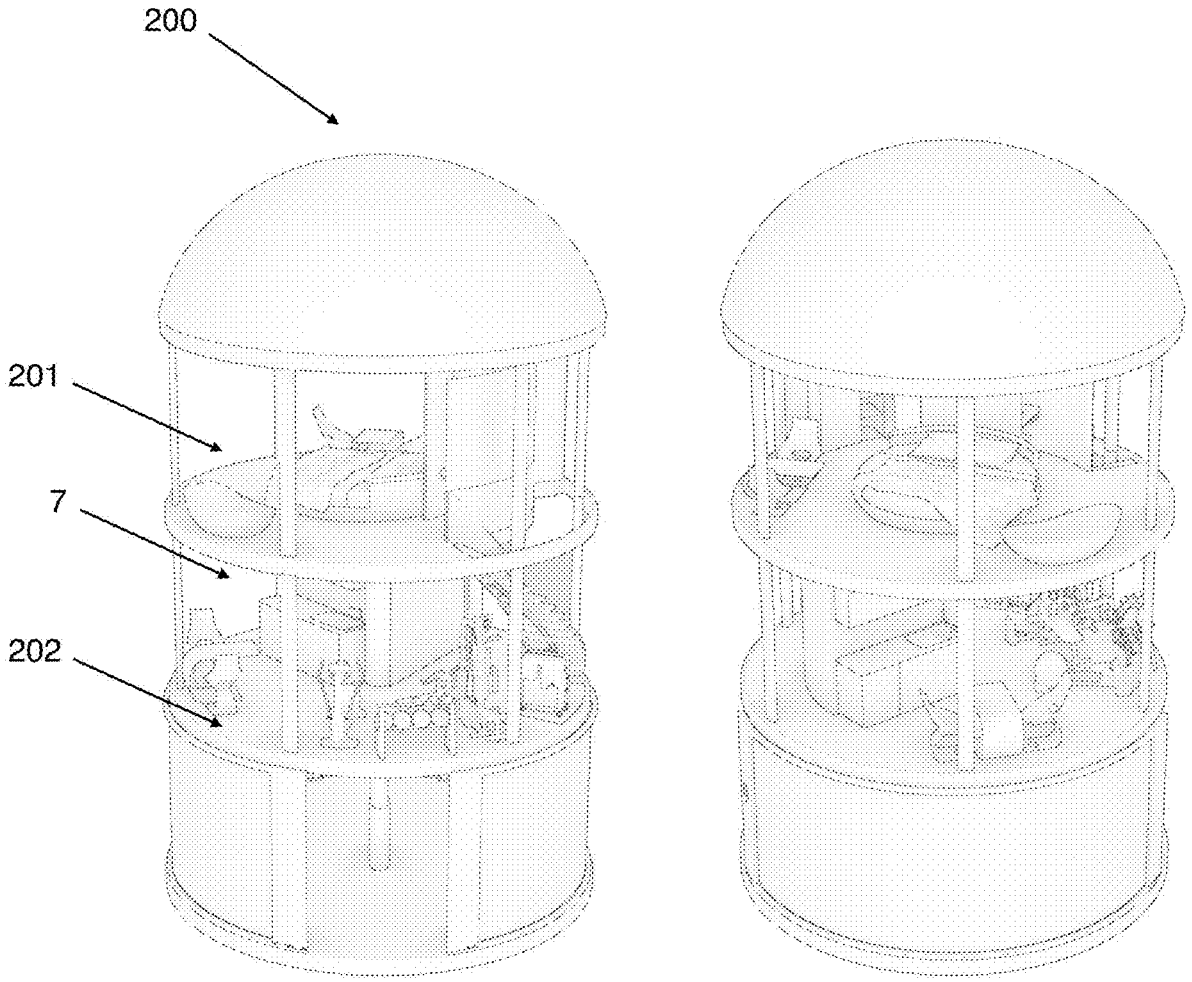
FIG. 5 illustrates a front and back view of the living area embodiment.
Figure 6:
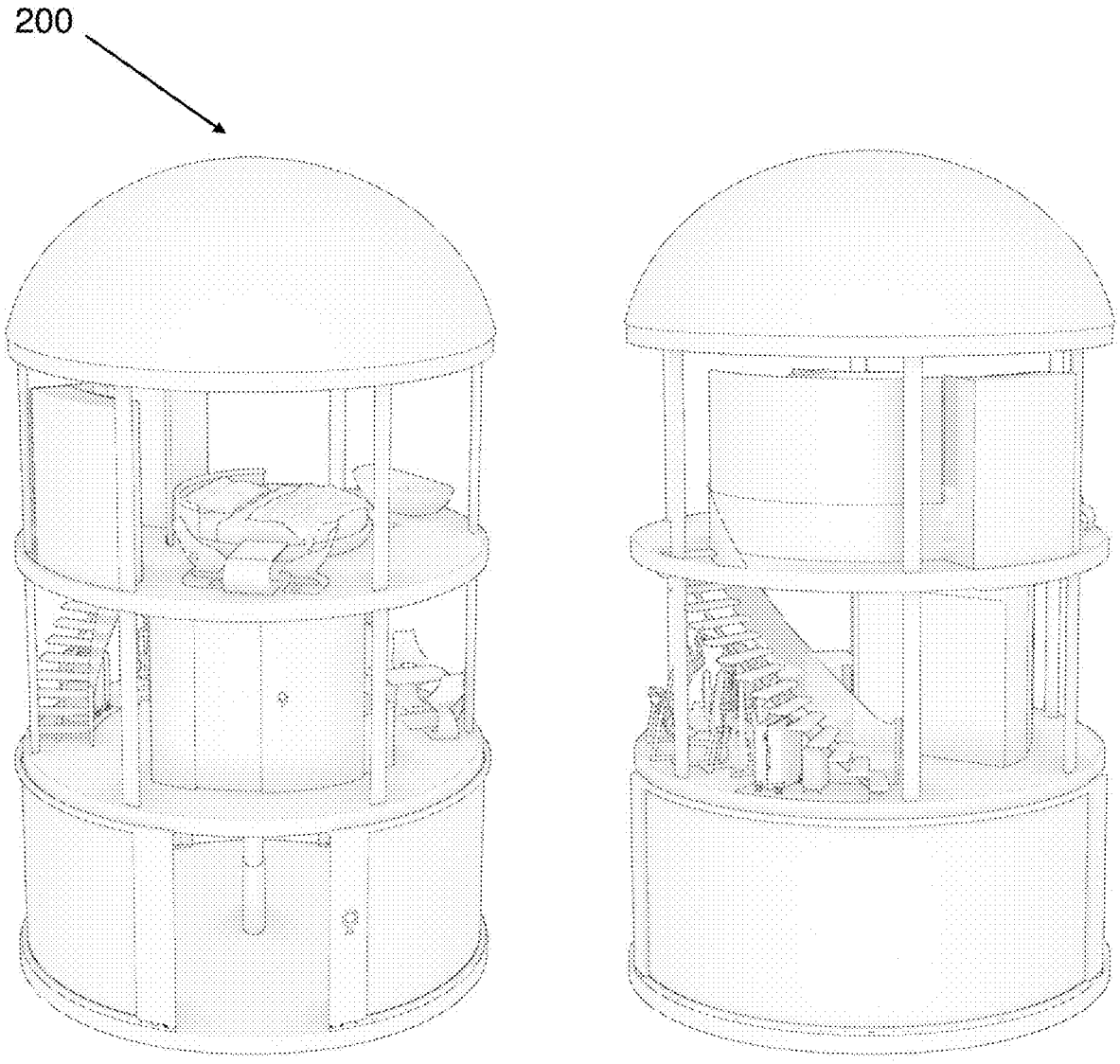
FIG. 6 illustrates side views of the living area of FIG. 5.
Figure 7:
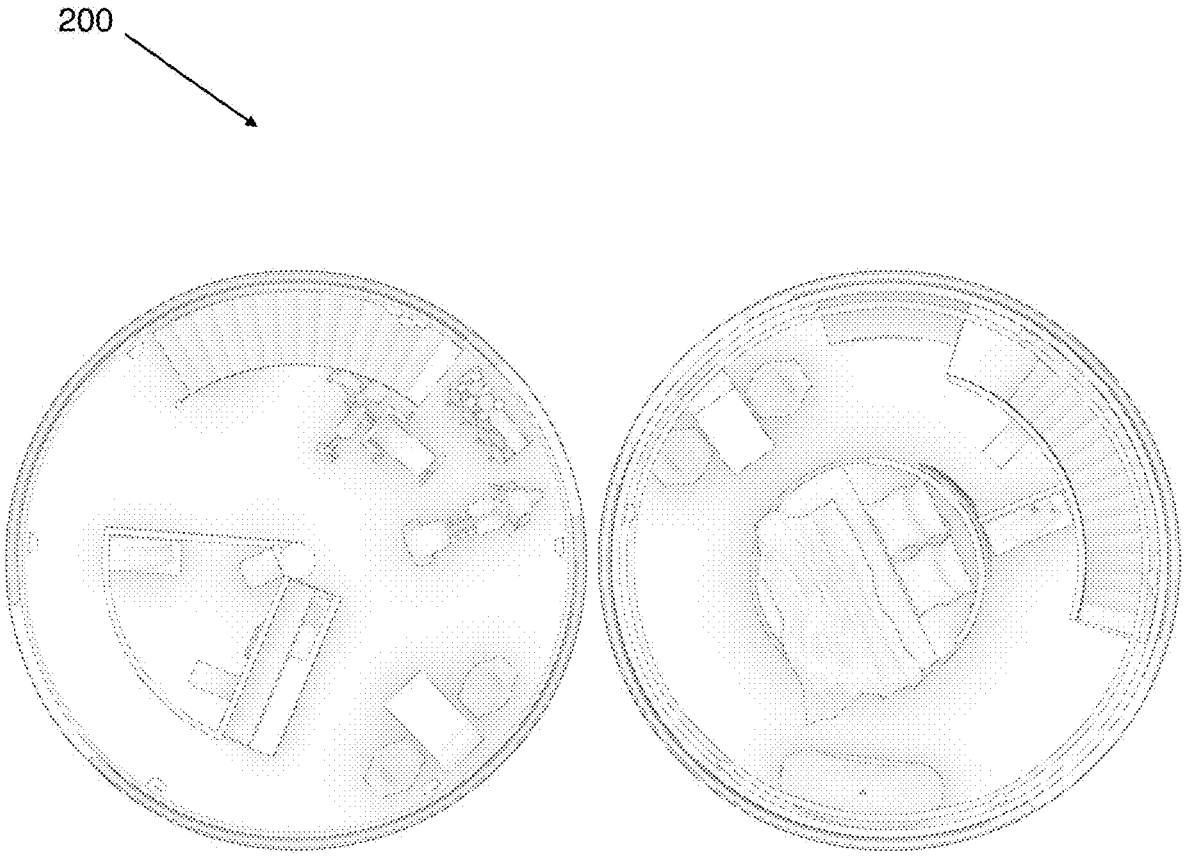
FIG. 7 illustrates top views of the floors of the living area of FIG. 5.
Figure 8:
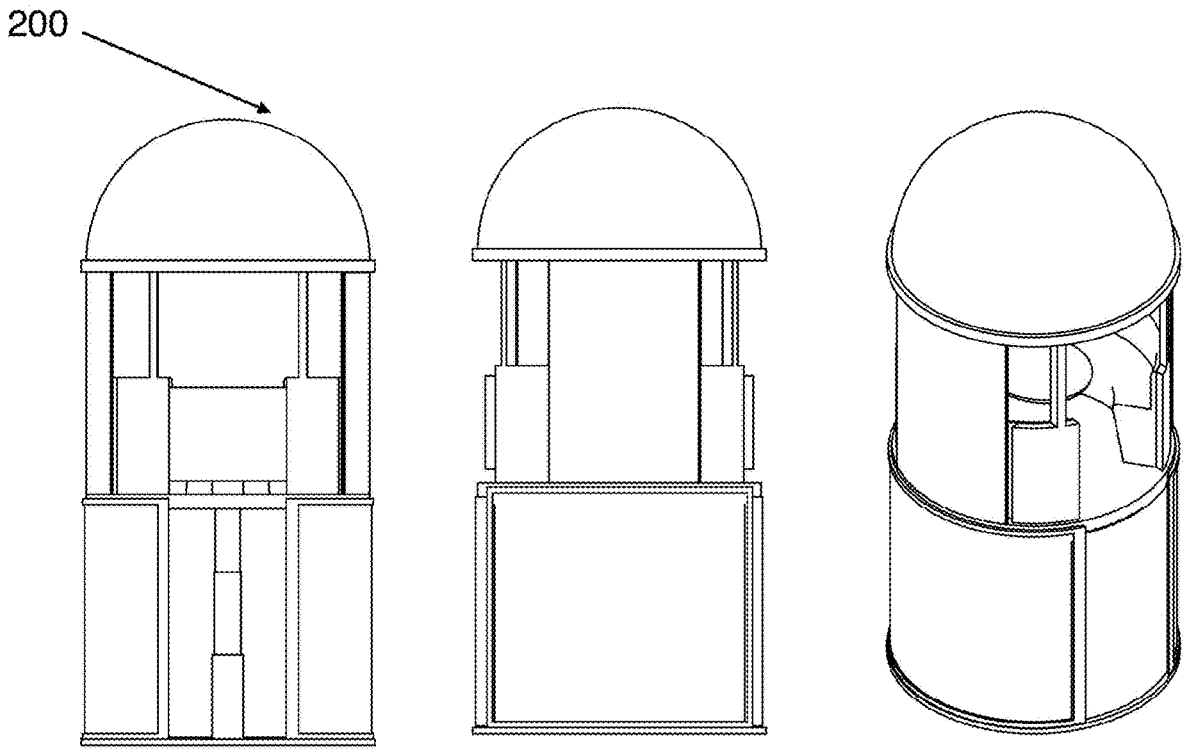
FIG. 8 illustrates another embodiment of the living area.
Figure 9:
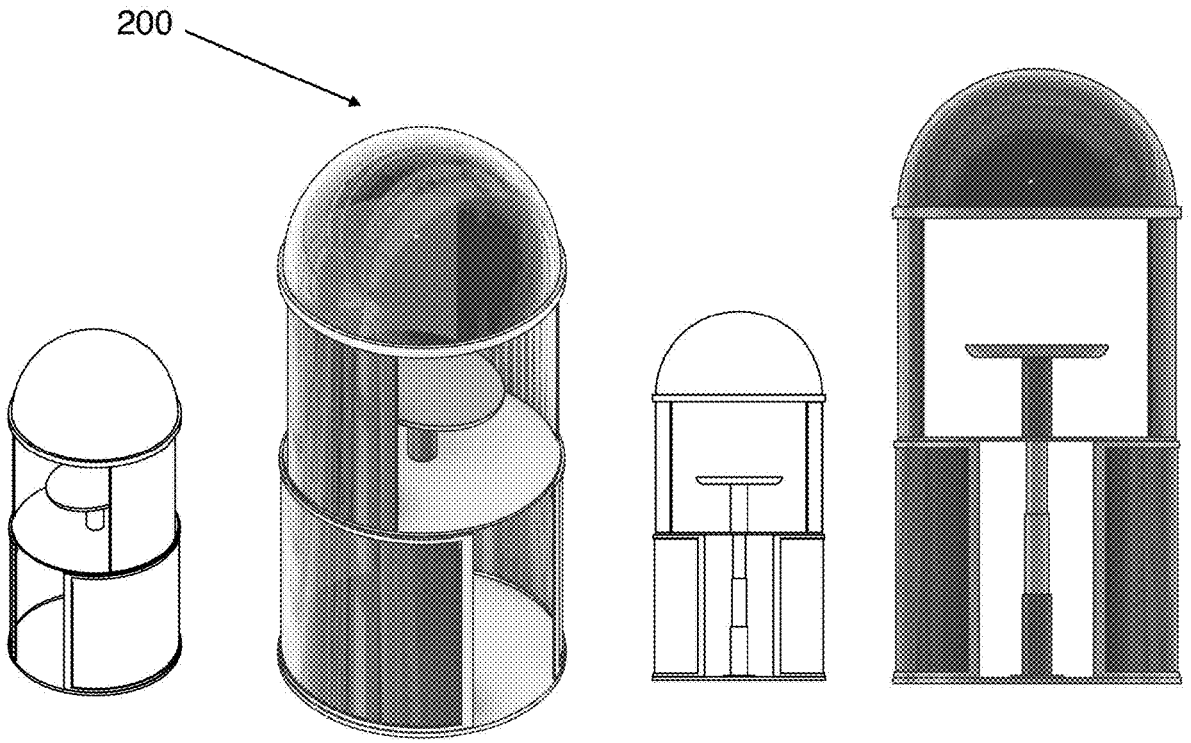
FIG. 9 illustrates another embodiment of the living area.

FIGS. 5, 6, and 7 illustrate a living area 200 for housing or entertaining guests with similar machinations to eatery 100 with a moveable and accessible platform 7 being provided according to the invention, on which the one table element 3 and the two seating elements 4 are arranged. Living area 200 is just one of many possible combinations used with similar technologies to eatery 100 whereby users may occupy the space to perform various activities such as sleeping or working out. Living area 200 may be utilized as a home, a hotel, a rental, or any other type of living situation whereby platform 7 may be raised and controlled by user or when user interacts with a payment system similar to eatery 100. In this embodiment living area 200 may have one or more levels such as levels 201 and 202 corresponding to different floors or rooms. For instance, in this embodiment of living area 200, a bedroom may be positioned on level 201 while a work out area may be positioned on level 200. As in eatery 100, a user may remotely control the various objects in living area by a remote computing device. FIGS. 8 and 9 illustrate another embodiments of living area 200.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. An eatery having a seating area, the seating area having at least one table element and at least one seating element, wherein a platform, on which the at least one table element and the at least one seating element are arranged, is provided, and wherein at least one elevation device for raising the platform is arranged in an area below the platform, the eatery having a top supported by a plurality of struts which are anchored at their bottom ends in exterior wall elements, the eatery having an integrated cooling and heating system and ventilation slots are integrated into the seating area of the at least one seating element.

2. The eatery according to claim 1, further comprising an annular member configured to accommodate a plurality of loudspeakers.

3. The eatery according to claim 1, wherein the platform is rotatable around a vertical axis.

4. The eatery according to claim 1, wherein the top is transparent and made of an acrylic glass configured to allow for unimpeded observation of an environment and a projection wall.

5. The eatery according to claim 1, a credit card reader integrated into the at least one table element for processing of orders, a touchscreen imbedded in the at least one table element, the touchscreen having control commands including elevating and lowering the platform and a rotation speed of the platform.

6. An eatery having a seating area, the seating area having at least one table element and at least one seating element, wherein a platform, on which the at least one table element and the at least one seating element are arranged, is provided, and wherein at least one elevation device for raising the platform is arranged in an area below the platform, the eatery having a top supported by a plurality of struts which are anchored at their bottom ends in exterior wall elements, the eatery having a circular stabilizing disc used to secure the platform against tilting.

* * * * *